US006897379B1

(12) United States Patent
Hsiao

(10) Patent No.: US 6,897,379 B1
(45) **Date of Patent: *May 24, 2005**

(54) ROTATABLE EXTENSION CORD ASSEMBLY

(76) Inventor: Feng-Shen Hsiao, 10th Fl., No. 5, Sec. 1, Tun Hua S. Rd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/725,157

(22) Filed: Dec. 1, 2003

(51) Int. Cl.[7] ..... H01R 13/46

(52) U.S. Cl. ..... 174/53; 174/48; 174/50; 220/3.2; 220/3.7; 439/535; 439/650

(58) Field of Search ..... 174/50, 48, 49, 174/53, 59, 57; 220/3.2, 3.3, 3.8, 3.6, 3.94, 4.02, 4.01; 439/107, 535, 536, 538, 650, 502, 527, 652, 540, 651, 658, 528; 200/293, 297, 5 R

(56) References Cited

U.S. PATENT DOCUMENTS 4,993,970 A * 2/1991 Littrell ..... 174/48
5,575,668 A * 11/1996 Timmerman ..... 174/48
5,924,892 A * 7/1999 Ferracina ..... 439/535
6,200,159 B1 * 3/2001 Chou ..... 174/48
6,290,518 B1 * 9/2001 Byrne ..... 174/57
6,296,522 B1 * 10/2001 Ho ..... 439/540
6,452,108 B1 * 9/2002 Major ..... 174/50
6,568,946 B1 * 5/2003 Chou ..... 439/650
6,642,450 B1 11/2003 Hsiao

* cited by examiner

*Primary Examiner*—Dean A. Reichard
*Assistant Examiner*—Angel R. Estrada
(74) *Attorney, Agent, or Firm*—William E. Pelton, Esq.

(57) ABSTRACT

An extension cord assembly has a housing composed of a front casing and a rear casing, and two bases respectively and rotatably provided at opposite sides of the housing, wherein each base has multiple sockets formed thereon. Since the bases are rotatable, the base is able to be turned to a desired position to allow any plug to be easily inserted into the sockets on the bases.

19 Claims, 8 Drawing Sheets

ROTATABLE EXTENSION CORD ASSEMBLY

BACKGROUND OF THE INVENTION

1. Field of the Invention

The invention is related to an extension cord assembly, and more particularly to a rotatable extension cord assembly having two rotatable bases, on which sockets are defined, respectively and rotatably equipped at opposite sides of a housing of the extension cord assembly. With the two rotatable bases, the user is able to use the extension cord easily without worrying that wires of an electrical apparatus connected to the extension cord assembly will become tangled.

2. Description of Related Arts

With reference to FIG. 8, a general conventional extension cord assembly is constructed by a housing (50) with a top plate and a bottom plate. On the top plate, multiple pairs of first holes (51) and multiple second holes (52) are defined, wherein each second hole (52) corresponds to a pair of the first holes (51) to form a complete socket. At the bottom plate, an extension cord (not shown) is provided for connection to a power source, i.e. a wall outlet such that any electrical apparatus in connection with the extension cord assembly is able to be activated.

When the conventional extension cord assembly is used and when the user is walking around with a hand-held electrical tool, before long, the wires of the electrical tool will be tangled or the casing will be moved from its original position, which may put the user in jeopardy. That is, if the extension cord assembly housing (50) is moved to a wet location, the moisture may cause an electrical short and damage the electrical tool or an electrical shock to the user.

To overcome the mentioned shortcomings, an extension cord assembly in accordance with the present invention is introduced to mitigate the aforementioned problems.

SUMMARY OF THE INVENTION

The objective of the present invention is to provide an extension cord assembly with two rotatable bases on which sockets are formed such that movement of any electrical apparatus in connection with the extension cord assembly will not cause the extension cord assembly to move and thus a user's safety is secured.

To accomplish the objective, the extension cord has a housing with two opposite sides where two bases are respectively and rotatably fitted, wherein each base has at least one socket formed thereon for electrical connection with electrical appliances.

The features and structure of the present invention will be more clearly understood when taken in conjunction with the accompanying figures.

DETAILED DESCRIPTION OF THE PREFERRED EMBODIMENT

Figure 1:
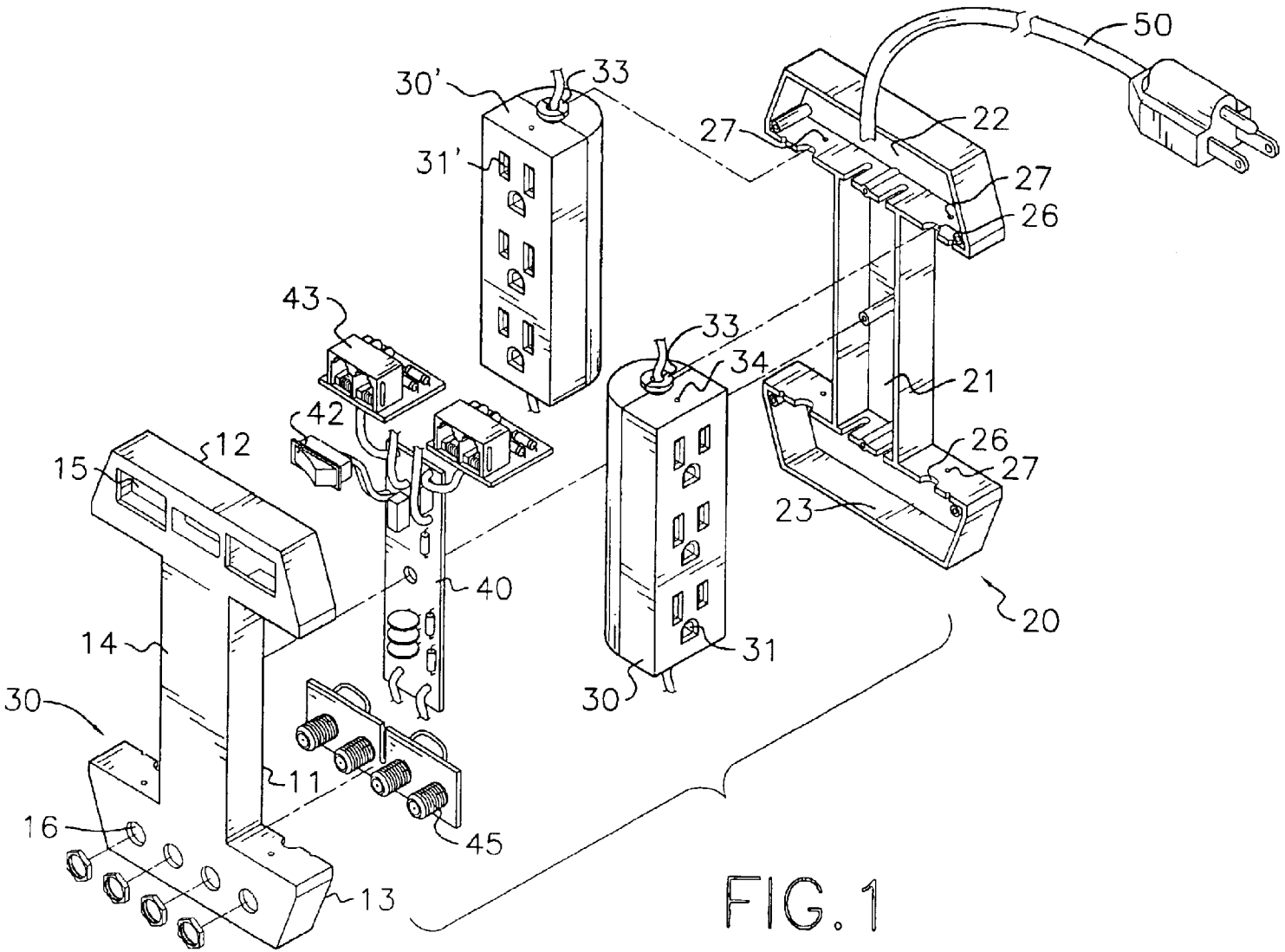
FIG. 1 is an exploded perspective view of the extension cord assembly in accordance with the present invention.

With reference to FIG. 1, an extension cord assembly in accordance with the present invention has a housing composed of a front casing (10) and a rear casing (20). The front and rear casings (10,20) are configured to be symmetrical each other. Each of the front and rear casing (10,20) is formed with a rectangular center chamber (11,21) with opposites sides that respectively communicate with a trapezoid upper chamber (12,22) and a trapezoid lower chamber (13,23). Therefore, each of the front casing (10) and the rear casing (20) is formed to be a substantially I-shaped casing. After the two casings (10,20) are correspondingly combined, two lengthwise spaces (not numbered) are accordingly formed at opposites sides of the two rectangular center chambers (11,21) and between the upper chambers (12,22) and the lower chambers (13,23).

Two bases (30,30'), each of which has multiple sockets (31,31') formed thereon, are respectively placed in the two lengthwise spaces and rotatably received between the upper chamber (12,22) and the lower chamber (13,23).

A circuit board (40) is to be installed inside the rectangular center chambers (11,21) after the front casing (10) and the rear casing (20) are combined. A switch (42) and multiple telephone wire connectors (43) are electrically provided on the circuit board (40). The switch (42) is provided to control whether all the sockets (31) of the two bases (30,30') are able to conduct electricity. The two bases (30,30') are electrically connected to the circuit board (40) such that each socket (31) is able to conduct electricity when a wire (50) extending from the circuit board (40) is connected to an outlet (not shown) in a wall.

Figure 2:
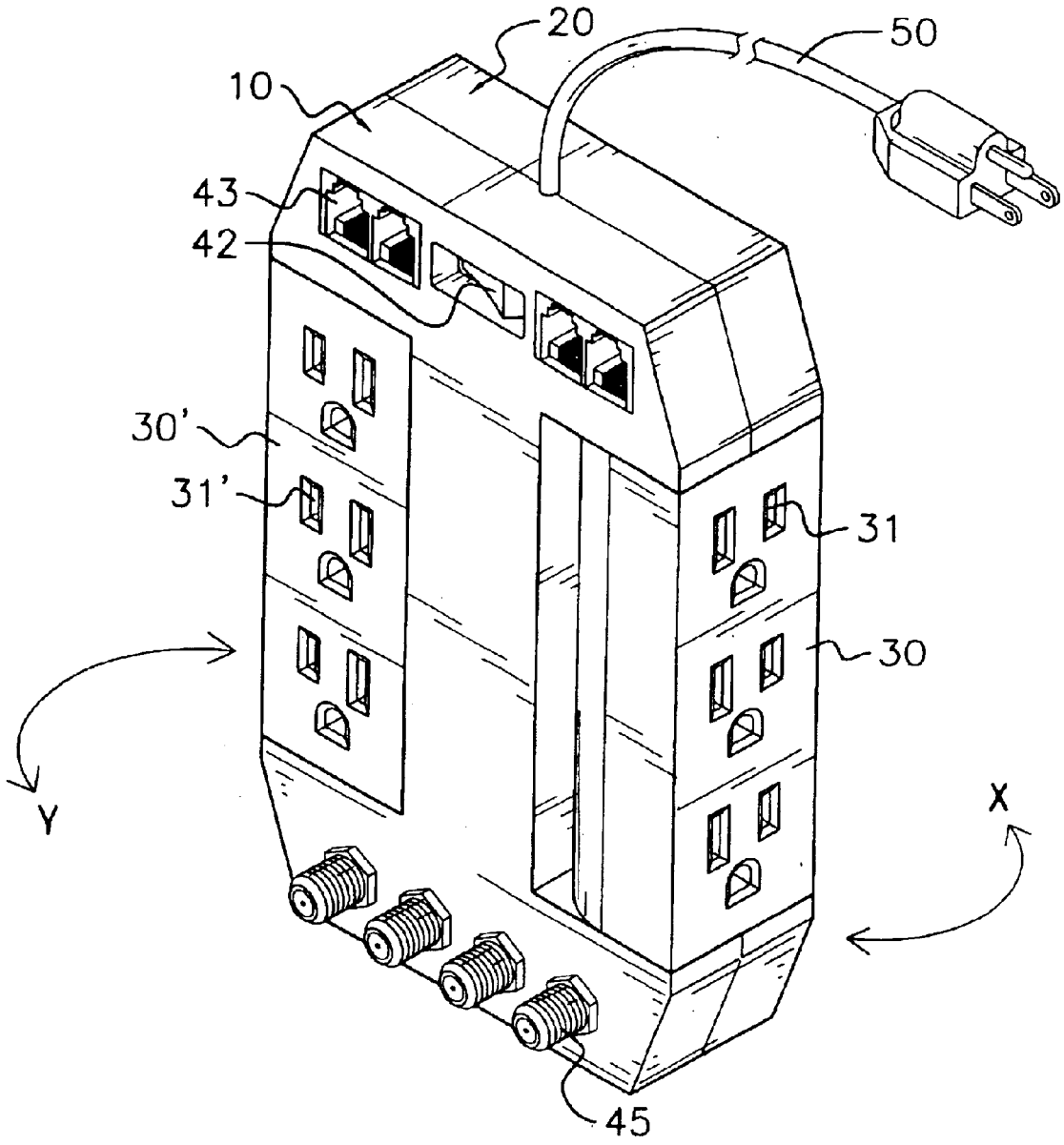
FIG. 2 is a perspective view of a first embodiment of the extension cord assembly in FIG. 1.
Figure 3:
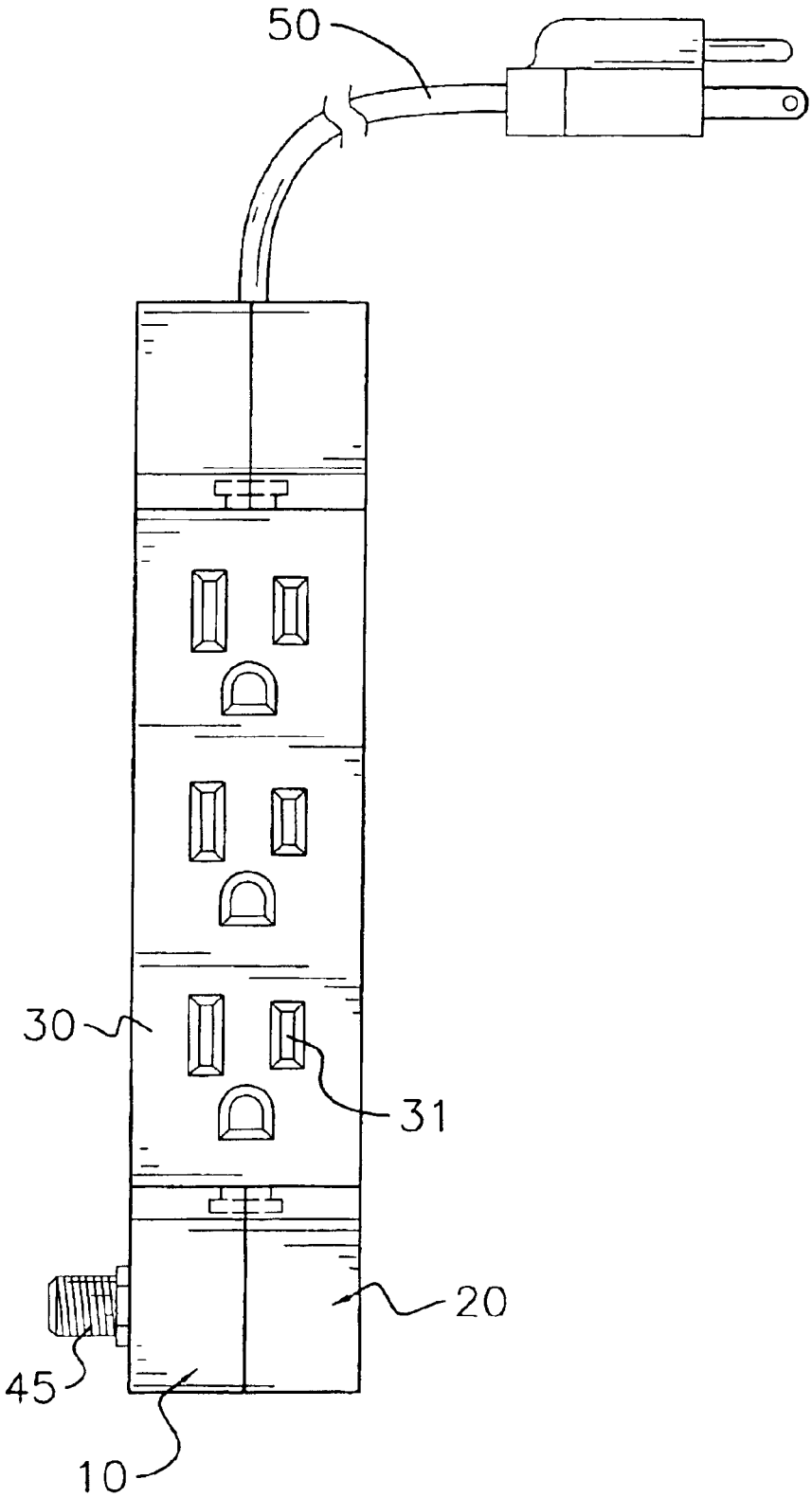
FIG. 3 is a side plan view of the extension cord assembly of FIG. 1.

With reference to FIGS. 1, 2 and 3, on a front face (14) of the front chamber (10), multiple rectangular through windows (15) and multiple circular holes (16) are defined to respectively communicate with the upper chamber (12) and the lower chamber (13). Thereby, when the circuit board (40) is retained inside an upper space composed of the upper chambers (12,22), the telephone wire connectors (43) and the switch (42) are able to be exposed through the multiple windows (15) for connection with telephone wires (not shown). Moreover, two pairs of coaxial cable connectors (45) are received inside the lower chambers (13,23) and extend through the circular holes (16).

Figure 4:
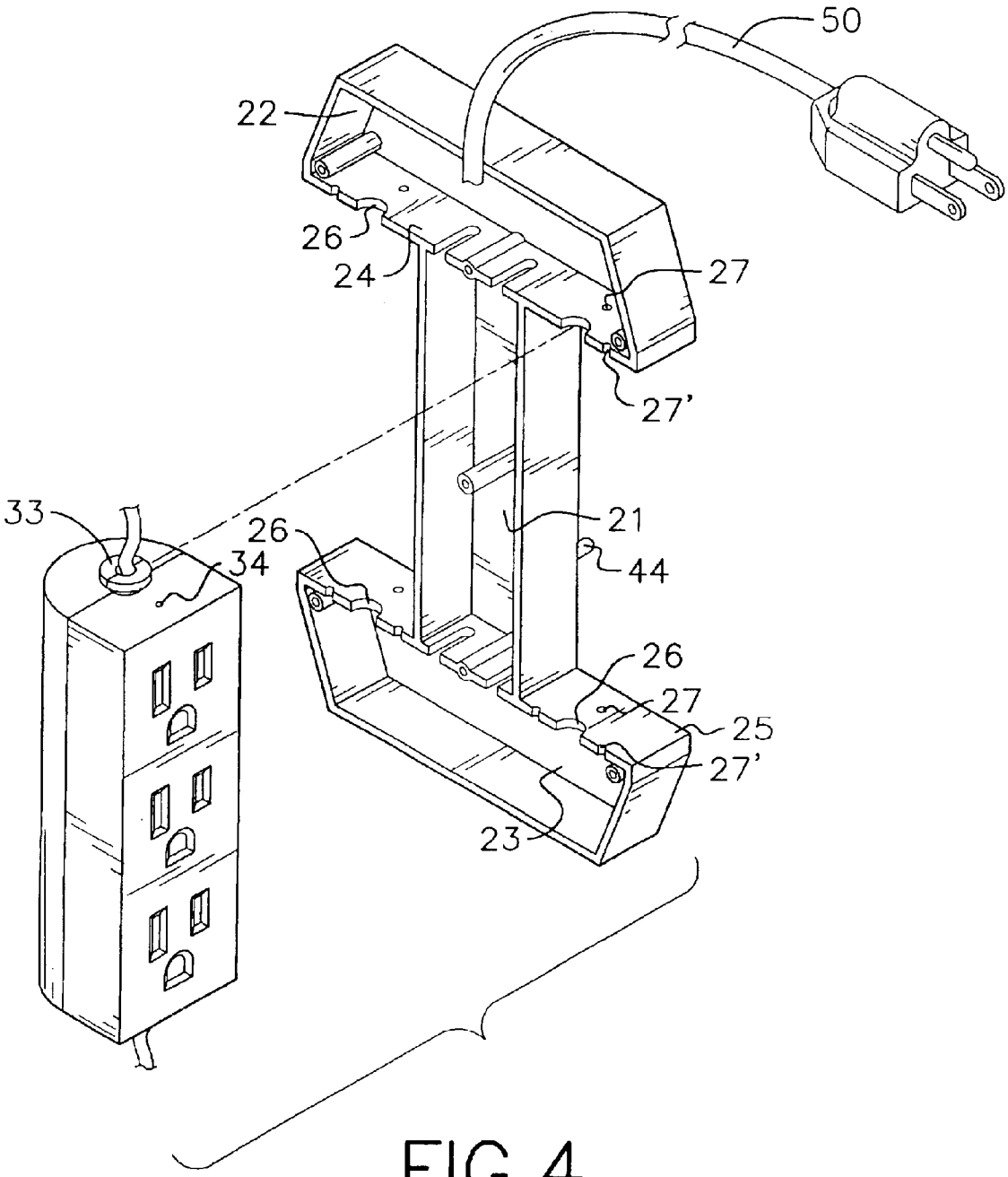
FIG. 4 is an exploded perspective view showing a second embodiment of a base and a casing.
Figure 6:
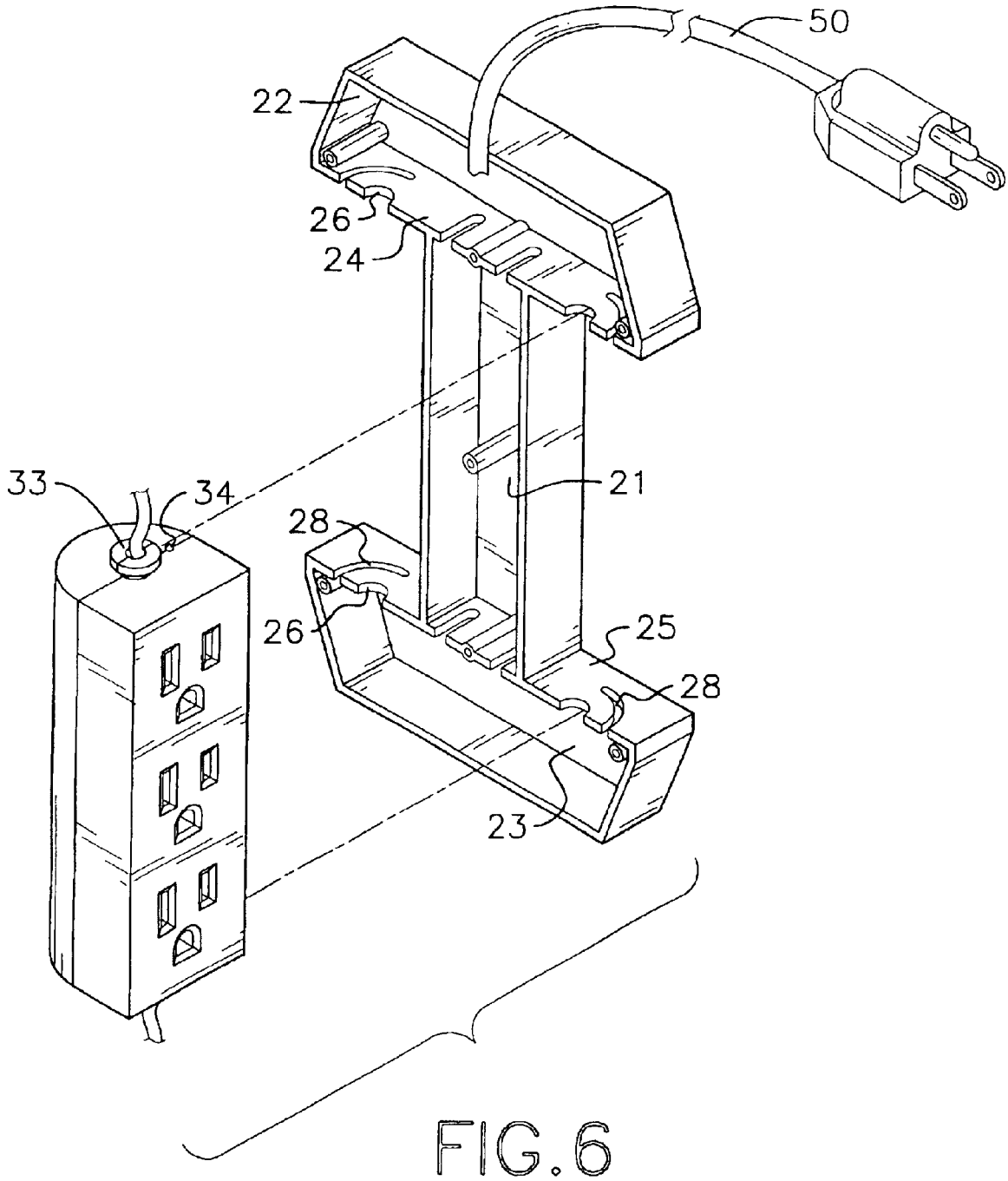
FIG. 6 is an exploded perspective view showing a second embodiment of a base and a casing.

To accomplish the rotatable connection between the bases (30,30') and the housing, the present invention discloses two embodiments as shown in FIGS. 4 and 6, respectively.

Figure 5:
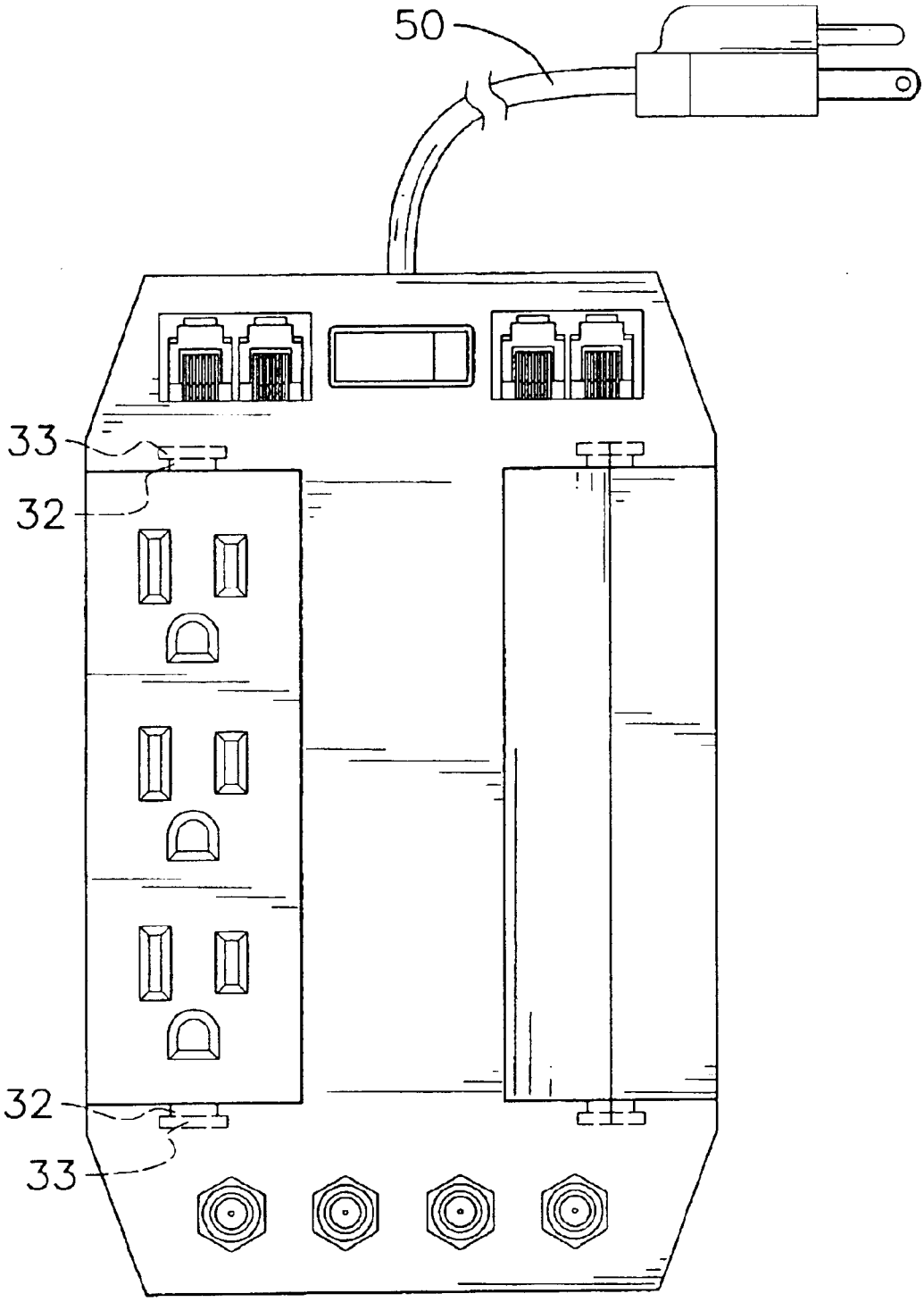
FIG. 5 is a front plan view of the extension cord assembly of FIG. 1.

With reference to FIGS. 1, 4 and 5, each base (30,30') has two opposite ends from which an axle (32) formed with a head (33) extends out therefrom. Further, two protrusions (34) are also respectively formed at the opposite ends of the bases (30,30').

As foregoing mentioned, since the front casing (10) and the rear casing (20) are substantially symmetrical with each other, rotating structures defined in the rear casing (20) are only discussed hereinafter, and the rotating structures of the front casing (10) are thus omitted for brevity. As shown in FIG. 4, the rear chamber (20) has two opposite partitions (24,25) that respectively construct the upper chamber (22) and the lower chamber (23). Along a flange of each partition (24,25), two semicircular cuts (26) are respectively defined and apart from each other. Moreover, multiple tiny through holes (27) are defined in the two opposite partitions (24,25) and distributed near each semicircular cut (26) to correspond to the protrusion (34) of the base (30). As shown in FIGS. 1 and 4, a semicircular cutout (27') is defined along the flange of each partition (24,25) and near the semicircular cut (26). Thereby after the front casing (10) and the rear casing (20) are combined, two semicircular cutouts (27') of each casing (10,20) are formed as a circular hole otherwise identical to the other through holes (27) to correspond to the protrusion (34).

To assemble the two bases (30,30') in accompaniment with the front casting (10) and the rear casing (20), the two axles (32) at the opposite ends of each base (30,30') are respectively passed through the two circular openings composed of the four corresponding semicircular cuts (26) of the two casings (10,20). Thereby, two heads (33) on the two axles (32) of each base (30,30') are respectively retained inside the upper chambers (12,22) and the lower chambers (13,23). Thus, the two bases (30,30') are rotatably connected between the upper chambers (12,22) and the lower chambers (13,23).

Moreover, the two protrusions (34) at opposites ends of each base (30,30') in conjunction with the tiny through holes (27) and cutouts (27') allow the base (30,30') to be oriented at a particular position when the protrusions (34) are correspondingly matched with the through holes (27) and the cutouts (27').

For example, as shown in FIG. 2, one base (30) with the surface having sockets (31) is rotated to face a direction X when the two protrusions (34) just correspond to and are received in the two holes (27). The other base (30') is faced toward another direction designated with Y.

With reference to FIG. 6, the through holes (27,27') as shown in FIG. 4 are replaced by arcuate slots (28) in this embodiment. These arcuate slots (28) can be formied as through slots as shown in the drawing, or as shallow slots defined at an external surface of the partitions (24,25). Thereby the protrusions (34) are able to slide along these arcuate slots (28) when the entire base is rotated.

Figure 7:
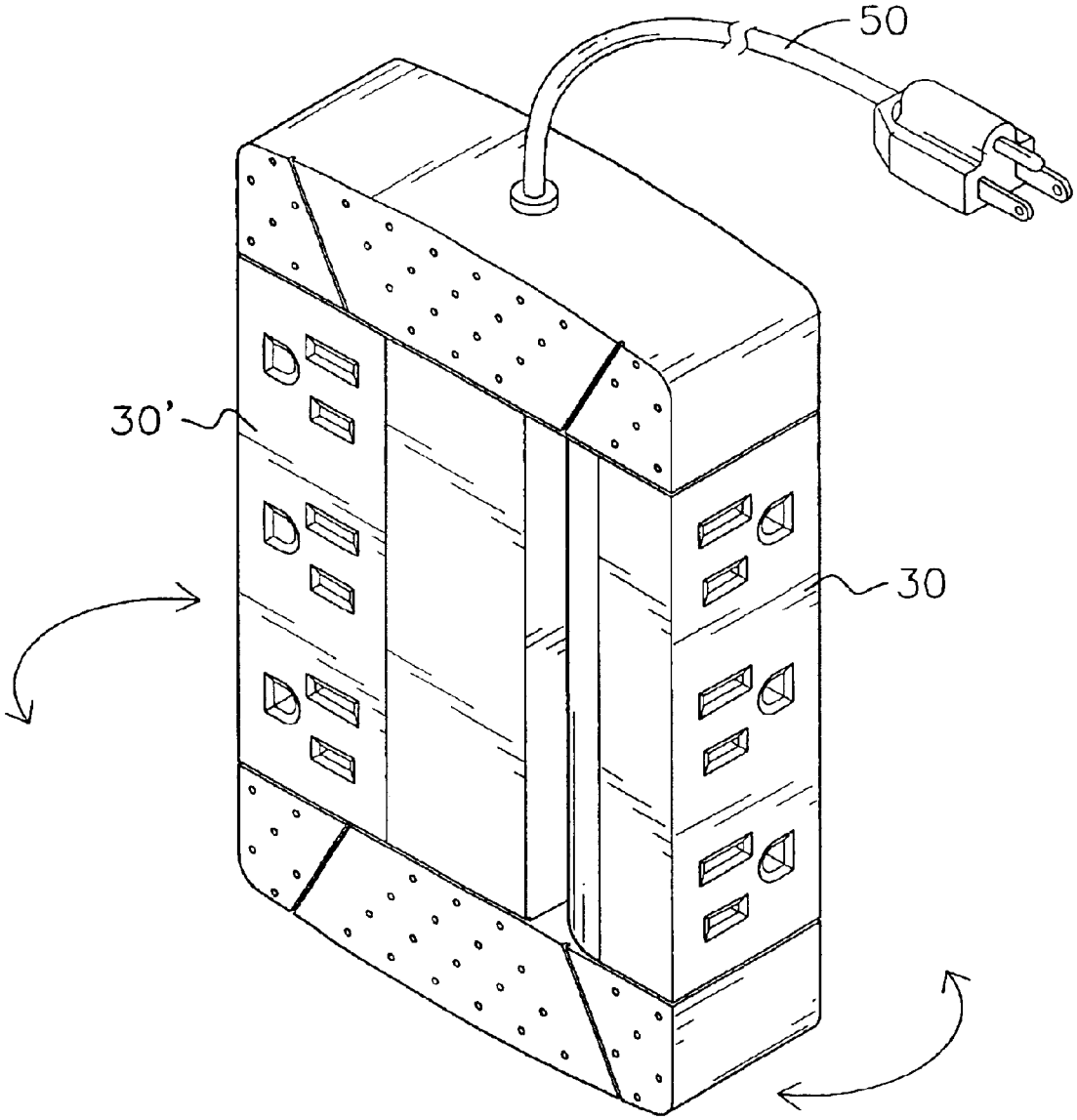
FIG. 7 is a perspective view of a second embodiment of an extension cord assembly in accordance with the present invention.
Figure 8:
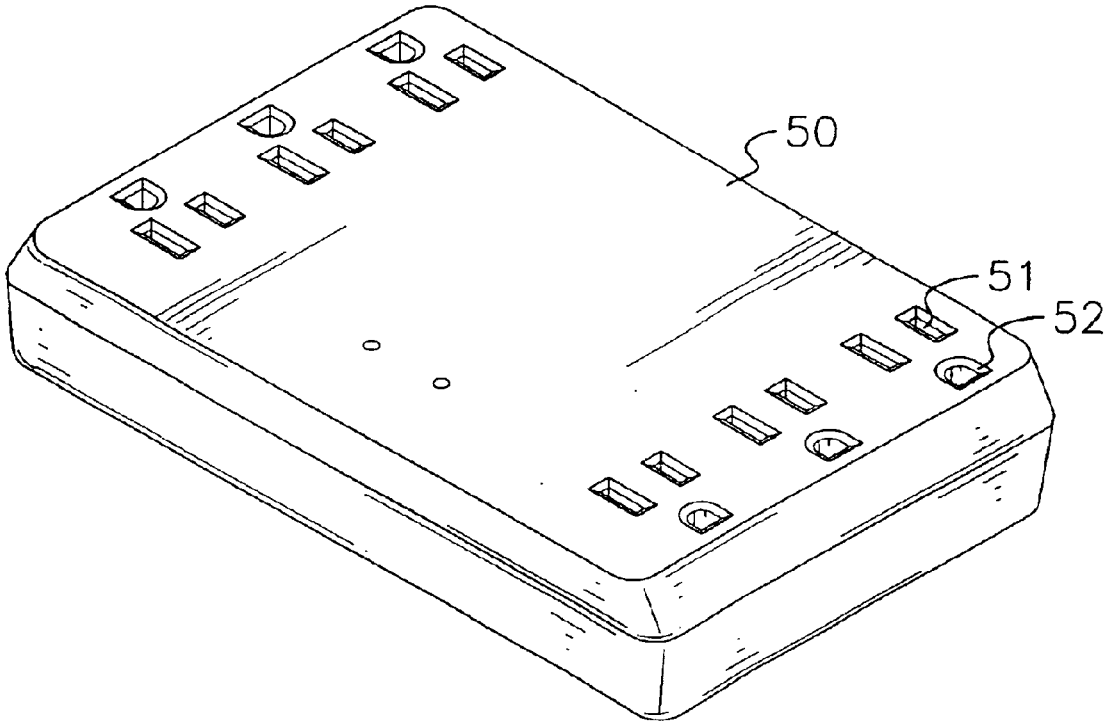
FIG.8 PRIOR ART
FIG. 8 is a perspective view of a conventional extension cord assembly.

With reference to FIG. 7, a second embodiment of an extension cord assembly in accordance with the present invention is shown. The extension cord assembly is substantially the same as that of FIG. 2. The difference is that the telephone wire connectors (43) and the coaxial cable connectors (45) are all omitted. Still, the two bases (30,30') are rotatably provided between the upper chambers (12,22) and the lower chambers (13,23) as shown in the embodiment in FIG. 6.

The foregoing description of the preferred embodiments of the present invention is intended to be illustrative only and, under no circumstances, should the scope of the present invention be restricted by the description of the specific embodiment.

What is clamed is:

1. An extension cord assembly comprising:

a housing having a front casing and a rear casing symmetrical to the front casing; and two bases rotatably provided at opposite sides of the housing, wherein each base has at least one socket defined therein, each of said casing comprising an upper chamber;

a lower chamber; and a center chamber therebetween, said upper and lower chambers being in communication with the center chamber, whereby the combination of said front and rear casings defines two lengthwise spaces for receiving the two bases, said spaces being formed at opposite sides of the combined center chambers and between the upper and lower chambers.

2. The extension cord assembly as claimed in claim 1, wherein after the front casing and the rear casing are assembled together, an upper space is defined by the two upper chambers of the front casing and the rear casing to receive multiple telephone wire connectors, wherein a front surface of the front casing is defined with multiple through windows to correspond to the multiple telephone wire connectors so that each telephone wire connector is exposed.

3. The extension cord assembly as claimed in claim 1, wherein after the front casing and the rear casing are assembled together, a lower space is defined by the two lower chambers of the front casing and the rear casing to receive multiple coaxial cable connectors, wherein a front surface of the front casing is defined with multiple through holes to correspond to the multiple coaxial connectors so that each coaxial cable connector extends out from the front casing.

4. The extension cord assembly as claimed in claim 2, wherein after the front casing and the rear casing are assembled together, a lower space is defined by the two lower chambers of the front casing and the rear casing to receive multiple coaxial cable connectors, wherein the front surface of the front casing is further defined with multiple through holes to correspond to the multiple coaxial connectors so that each coaxial cable connector extends out from the front casing.

5. The extension cord assembly as claimed in claim 1, wherein each base has two opposite ends, each end having a protrusion and an axle formed with a head.

6. The extension cord assembly as claimed in claim 2, wherein each base has two opposite ends, each end having a protrusion and an axle formed with a head.

7. The extension cord assembly as claimed in claim 3, wherein each base has two opposite ends, each end having a protrusion and an axle formed with a head.

8. The extension cord assembly as claimed in claim 4, wherein each base has two opposite ends, each end having a protrusion and an axle formed with a head.

9. The extension cord assembly as claimed in claim 5, wherein both the front chamber and the rear chamber have two opposite partitions that respectively construct the upper chamber and the lower chamber, wherein along a flange of each partition, two semicircular cuts are defined and apart from each other.

10. The extension cord assembly as claimed in claim 6, wherein both the front chamber and the rear chamber have two opposite partitions that respectively construct the upper chamber and the lower chamber, wherein along a flange of each partition, two semicircular cuts are defined and apart from each other.

11. The extension cord assembly as claimed in claim 7, wherein both the front chamber and the rear chamber have two opposite partitions that respectively construct the upper chamber and the lower chamber, wherein along a flange of each partition, two semicircular cuts are defined and apart from each other.

12. The extension cord assembly as claimed in claim 8, wherein both the front chamber and the rear chamber have two opposite partitions that respectively construct the upper chamber and the lower chamber, wherein along a flange of each partition, two semicircular cuts are defined and apart from each other.

13. The extension cord assembly as claimed in claim 9, wherein each partition is defined with a plurality of through holes to correspond to the protrusions.

14. The extension cord assembly as claimed in claim 10, wherein each partition is defined with a plurality of through holes to correspond to the protrusions.

15. The extension cord assembly as claimed in claim 11, wherein each partition is defined with a plurality of through holes to correspond to the protrusions.

16. The extension cord assembly as claimed in claim 12, wherein each partition is defined with a plurality of through holes to correspond to the protrusions.

17. The extension cord assembly as claimed in claim 9, wherein each partition is defined with an arcuate slot to correspond to the protrusions.

18. The extension cord assembly as claimed in claim 10, wherein each partition is defined with an arcuate slot to correspond to the protrusions.

19. The extension cord assembly as claimed in claim 11, wherein each partition is defined with an arcuate slot to correspond to the protrusions.

* * * * *